US012139833B2

(12) United States Patent
Vaughan et al.

(10) Patent No.: US 12,139,833 B2
(45) Date of Patent: Nov. 12, 2024

(54) PATTERNED TUFTED ARTICLES, SURFACE COVERINGS COMPRISING SAME, AND SYSTEMS AND METHODS OF MAKING AND USING SAME

(71) Applicant: Columbia Insurance Company, Omaha, NE (US)

(72) Inventors: William Neil Vaughan, Rydal, GA (US); Philipe C. F. Aldahir, Chattanooga, TN (US); Jeffrey J. Wright, Cartersville, GA (US); James Jarrett, Cartersville, GA (US); Kyle Andrew Aylor, Cartersville, GA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 18/644,777

(22) Filed: Apr. 24, 2024

(65) Prior Publication Data

US 2024/0271344 A1 Aug. 15, 2024

Related U.S. Application Data

(63) Continuation of application No. 17/476,870, filed on Sep. 16, 2021, now Pat. No. 12,006,606.

(60) Provisional application No. 63/079,312, filed on Sep. 16, 2020.

(51) Int. Cl.

| | |
|---|---|
| ***D05C 17/02*** | (2006.01) |
| ***D05C 15/04*** | (2006.01) |
| ***E01C 13/08*** | (2006.01) |

(52) U.S. Cl.
CPC ..... *D05C 17/026* (2013.01); *D05C 15/04* (2013.01); *E01C 13/083* (2013.01); *D10B 2507/00* (2013.01)

(58) Field of Classification Search
CPC ..... D05C 17/026; D05C 17/02; D05C 15/04; D10B 2507/00; E01C 13/083
See application file for complete search history.

(56) References Cited

U.S. PATENT DOCUMENTS

| | | | | |
|---|---|---|---|---|
| 12,006,606 B1 * | 6/2024 | Vaughan | ..... | D05C 15/04 |
| 2005/0158482 A1 * | 7/2005 | Cook | ..... | E01C 13/08 428/17 |

(Continued)

FOREIGN PATENT DOCUMENTS

| | | | | |
|---|---|---|---|---|
| WO | WO-2007146118 A2 * | 12/2007 | ..... | A47G 27/0275 |
| WO | WO-2012159145 A1 * | 11/2012 | ..... | A01G 20/00 |

*Primary Examiner* — Ismael Izaguirre
(74) *Attorney, Agent, or Firm* — Ballard Spahr LLP

(57) ABSTRACT

A tufted article (e.g., an artificial turf panel) having a backing and a plurality of tufts extending through the backing. The plurality of tufts are distributed among a plurality of patterned regions. Each patterned region has at least one tuft of the plurality of tufts. The tufts of each patterned region differ from the tufts of at least one other patterned region of the tufted article in at least one of color, pile height, yarn type, or yarn density. At least one patterned region creates a longitudinal discontinuity in the color pattern of the tufted article. The tufted article does not have a seam. Complementary side edges of the tufted articles can be secured together to form at least a portion of the surface covering without the need for cutting or the use of inlay components.

20 Claims, 11 Drawing Sheets

(56) References Cited

U.S. PATENT DOCUMENTS

| | | | | |
|---|---|---|---|---|
| 2008/0134949 | A1* | 6/2008 | Bearden | D05C 15/34 112/80.41 |
| 2009/0050037 | A1* | 2/2009 | Hall | D05C 15/12 112/80.32 |
| 2013/0298491 | A1* | 11/2013 | Oakey | A47G 27/0481 52/578 |
| 2020/0047363 | A1* | 2/2020 | Wadkins | B29C 65/5042 |

* cited by examiner

PATTERNED TUFTED ARTICLES, SURFACE COVERINGS COMPRISING SAME, AND SYSTEMS AND METHODS OF MAKING AND USING SAME

CROSS-REFERENCE TO RELATED APPLICATIONS

This application is a continuation of U.S. patent application Ser. No. 17/476,870, filed Sep. 16, 2021, which claims priority to and the benefit of the filing date of U.S. Provisional Patent Application No. 63/079,312, filed Sep. 16, 2020. Each of these applications is hereby incorporated herein by reference in its entirety.

FIELD

This application relates to tufted articles and, in particular, to artificial turf. This application also relates to systems and methods of manufacturing such tufted articles.

BACKGROUND

Current artificial sports turf is tufted in panels that are the result of tufting specifications that produce one particular product type. These specifications are a combination of components selected to make a turf product (primary backing, yarn type, size, denier, color, etc.), and machine setups related to pile length and number of stitches within a certain length. The pile length is determined by the travel distance of the tufting needles from the bed rail to the hook throat and the alignment of the yarn cutting blades. The number of stitches is related to the number of penetrations the yarn-carrying needles make into a primary backing moving at a certain speed. Current state of the art limits the variations that can be made to both pile length and the number of stitches, as most adjustments are made with the machine stopped in setup mode. As a result, artificial turf is made within a single specification, determining a single product type or use. Thus, to produce a field or other complex installation having multiple colors or textures, it is necessary to produce large numbers of discrete turf panels that are then manually cut and otherwise customized to be pieced together to form the installation. Such a process can lead to significant inefficiencies and high costs.

Further, using conventional techniques, any graphic elements within an artificial turf field, such as letters, numbers, lines, arches, dashed lines, and logos, are manually installed (e.g., through cutting and/or gluing) into the field during the overall field installation process. This process not only creates waste, but also results in a loss of field integrity and quality, and increase in variability, due to currently available installation techniques and sundries, as the quality of the field is highly tied to the quality of installation. In addition to the aesthetics of the field, cut and glued inlays might result in different playability metrics due to hardening of the glue, variation in infill depth, and turf planarity variability.

Thus, there is a need for artificial turf and other tufted articles that do not suffer from one or more of these deficiencies. There is a further need for systems and methods of producing such tufted articles while avoiding one or more of these deficiencies.

SUMMARY

Disclosed herein, in one aspect, is a tufted article (e.g., an artificial turf panel) having a length along a first axis and width along a second axis that is perpendicular to the first axis, with the first and second axes being perpendicular to a vertical axis. The tufted article includes a backing and a plurality of tufts extending through the backing. The backing has a continuous structure. The plurality of tufts are distributed among a plurality of patterned regions. Each patterned region includes at least one tuft of the plurality of tufts, and the tufts of each patterned region differ from the tufts of at least one other patterned region of the tufted article in at least one of color, pile height, yarn type, or yarn density. At least one patterned region forms a discontinuity in a color pattern of the tufted article moving along the first axis. The tufted article does not comprise a seam.

Two or more such tufted articles can be tufted to have complementary side edges that can be secured together to form at least a portion of a surface covering, such as, for example, a portion of an artificial turf field. At the complementary side edges of the tufted articles, each patterned region of a first tufted article is in alignment with a corresponding patterned region of an adjacent, second tufted article to cooperatively define a continuous pattern extending from the first tufted article to the second tufted article.

A method of manufacturing a tufted article can comprise tufting the plurality of tufts through at least a portion of the backing, wherein tufting the plurality of tufts through the backing includes using a plurality of sequentially positioned tufting machines to tuft respective portions of the plurality of tufts, with each tufting machine defining at least one respective tufting zone.

A method of forming a surface covering using at least first and second tufted articles as disclosed herein can include securing complementary side edges of the first and second tufted articles together to form at least a portion of the surface covering. At the complementary side edges of the first and second tufted articles, each patterned region of the first tufted article is in alignment with a corresponding patterned region of the second tufted article to cooperatively define a continuous pattern extending from the first tufted article to the second tufted article.

A system capable of forming a tufted article as disclosed herein can include a plurality of tufting machines, a backing feed roll, at least one tensioning apparatus, and at least one controller. Each tufting machine defines a respective tufting zone and includes a plurality of needles that are configured to deliver yarn into a backing to form a plurality of tufts that extend through the backing. The backing has a length along a first axis and a width along a second axis that is perpendicular to the first axis. The backing feed roll is configured to feed the backing through the plurality of tufting machines. The at least one tensioning apparatus is configured to guide the backing through the plurality of tufting machines while applying tension to the backing. Each controller of the at least one controller is communicatively coupled with each tufting machine of the plurality of tufting machines. The at least one controller is configured to cause the plurality of tufting machines to selectively control delivery of yarn into the backing to produce a plurality of patterned regions.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

FIG. 2A depicts two tufted articles having complementary, adjacent side edges for forming a portion of a surface covering. FIGS. 2B and 2C depict tufted articles having complementary, spaced side edges that are patterned to form a portion of a surface covering.

FIG. 6 depicts a series of spaced tufting machines and a catwalk.

Figure 1A:
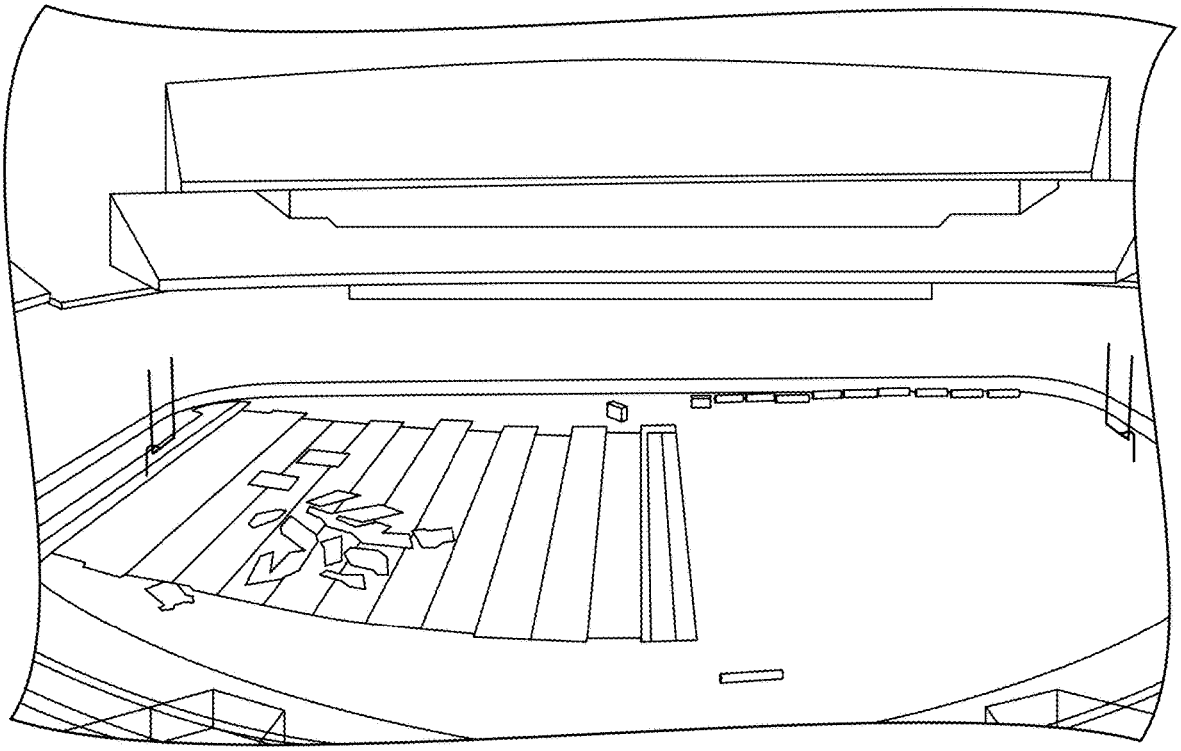
FIGS. 1A-1C are images of a conventional artificial turf installation. As shown, significant numbers of inlay components are manually inserted into openings that are formed within turf panels to provide a full surface covering and complete the installation.
Figure 1B:
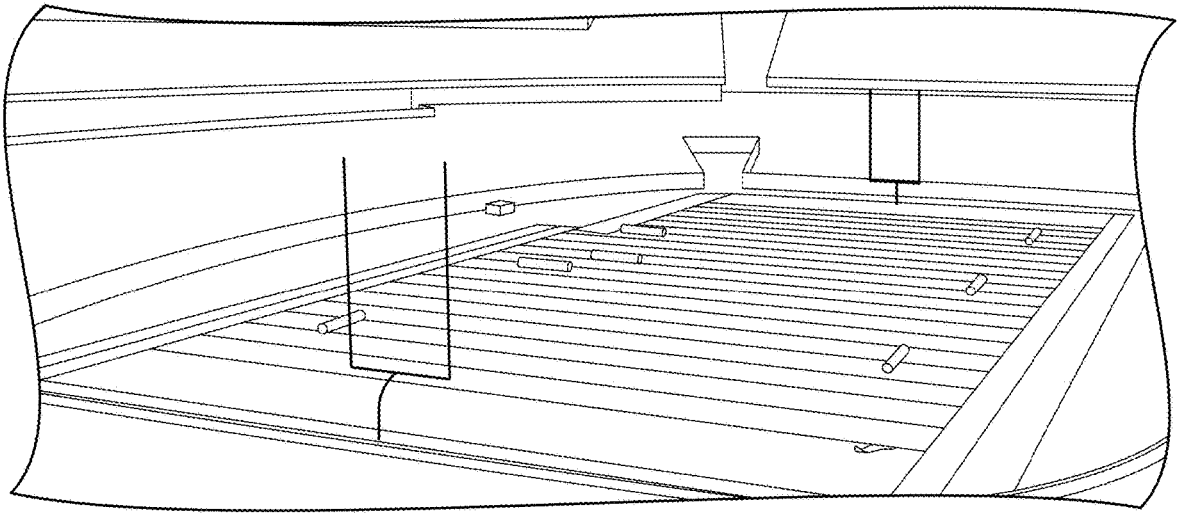

It should be understood that the drawings provided herein are not necessarily to scale. Rather, the drawings are formatted to help aid the understanding of certain features disclosed herein. For example, the relative sizes of the depicted tufts and backing materials shown in the figures are not necessarily indicative of what would be seen in the tufted articles disclosed herein.

DETAILED DESCRIPTION

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the" include plural references unless the context clearly dictates otherwise. Thus, for example, reference to "a tuft" includes one or more of such tufts, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

As used herein, the definition of the term "color" is referenced in terms of the CIELAB color scale, which was created by the International Commission on Illumination (CIE). The CIELAB color scale provides a uniform scale for measuring and comparing the color values of different samples. Three different color measurements are used to determine the CIELAB color value of a given sample: 1) a white-black color measurement; 2) a red-green color measurement; and 3) a yellow-blue color measurement. The white-black color measurement represents the amount of white present in the sample relative to the amount of black present in the sample. The red-green color measurement represents the amount of red present in the sample relative to the amount of green present in the sample. The yellow-blue color measurement represents the amount of yellow present in the sample relative to the amount of blue present in the sample. CIELAB color scale values can be obtained using color measurement instruments known in the art, including, for example, HunterLab color measurement instruments. When two "colors" are referred to as being the same or "substantially" the same or matching or "substantially" matching, it should be understood that each of the three color measurements (in the CIELAB scale) for the colors being compared are equal or substantially equal.

The term "backing" as used herein includes both primary backing materials and secondary backing materials. The term "backing" refers to any conventional backing material that can be applied to a tufted product, such as a woven, a non-woven, a knitted, a needle punched fabric, as well as a stitch bonded primary backing material. As one skilled in the art will appreciate, materials such as polypropylene, polyesters, hemp, composites, blend, nylons, or cottons can be used to form the backing material.

As used herein in the context of describing a backing, the term "continuous structure" refers to a backing configuration in which, apart from the passage of yarn tufts through the backing, the backing, including any primary or secondary backing layers, has a uniform and/or consistent structure moving in each direction within the dimensions of a tufted article. It should be understood that the backing can have a "continuous structure" even if one or more of the backing materials is a composite material, provided the composite material has a uniform and/or consistent structure throughout the backing. For example, in a tufted article having a backing including a primary backing layer and a secondary backing layer, it is contemplated that the backing can have a continuous structure if the only interruptions in the uniformity and/or consistency of the backing structure relate to the passage of yarn through at least a portion of the backing. In contrast, an article that is formed by securing multiple tufted articles together does not have a "continuous structure." Optionally, it is contemplated that backings having a "continuous structure" can include one or more contiguous layers that are only interrupted by the passage of tufts through the backing.

The term "fiber" as used herein includes fibers of extreme or indefinite length (i.e. filaments) and fibers of short length (i.e., staple fibers).

The term "yarn" as used herein refers to a continuous strand or bundle of fibers. Such yarns can include, for example and without limitation, monofilament yarns, cut yarns, looped yarns, fibrillated yarns, multifilament yarns, twisted yarns, wrapped yarns, and the like. Optionally, yarns can be textured using conventional methods.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification. Thus, words denoting order, such as "first" or "next," should be interpreted as optional aspects unless plain meaning or logic dictates otherwise.

Figure 1C:
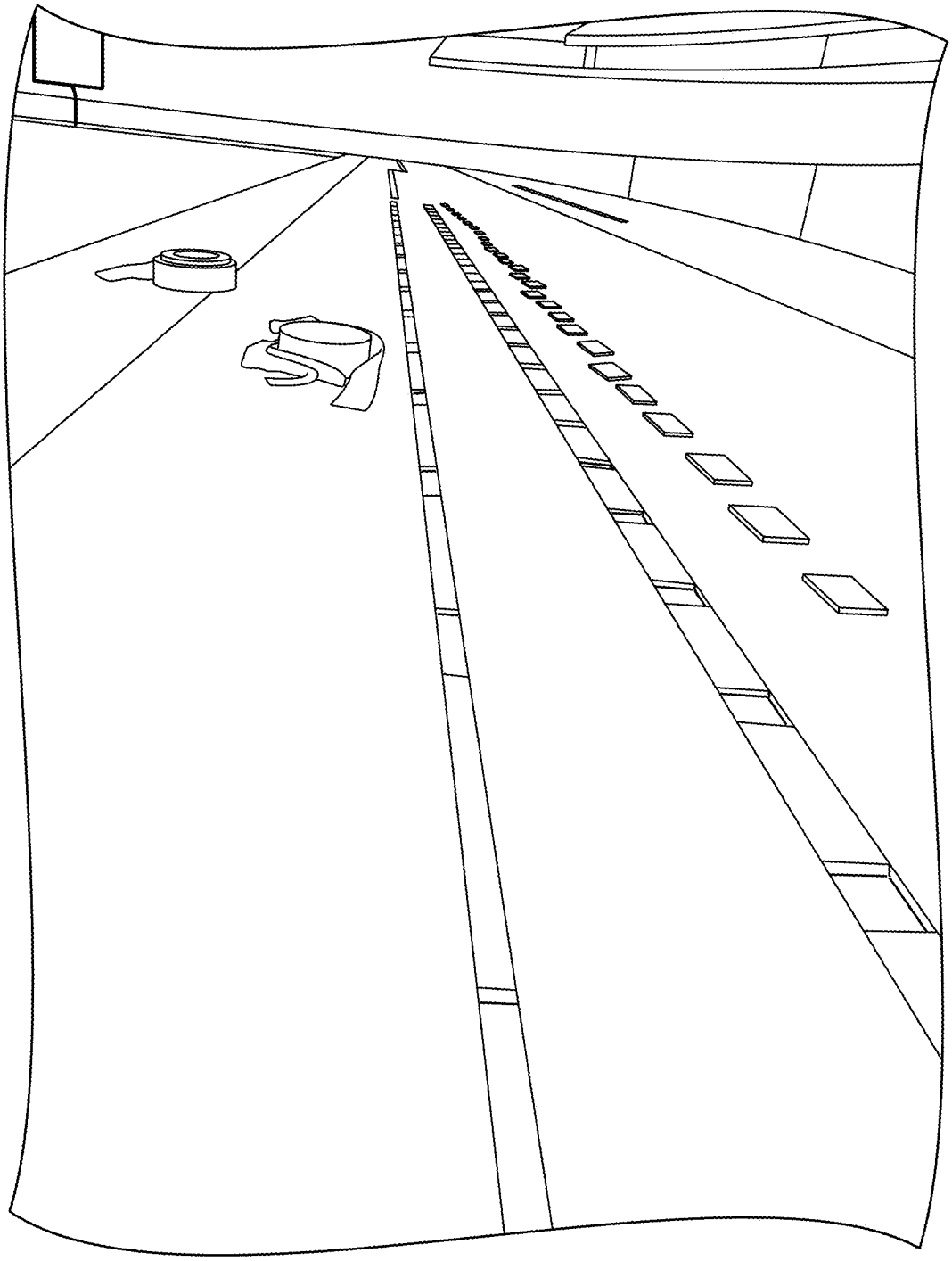

Referring to FIGS. 1A-IC, a conventional artificial turf product typically comprises turf panels that are selectively modified at the site of installation to incorporate graphics or other visual features into the turf. More particularly, turf panels having a uniform face pattern can be cut or positioned to provide openings or other void spaces where other turf panels or turf structures having different color yarns (or other different properties) can be resized and then placed in the void spaces. After the differently patterned turf panels (or other turf structures) are manually placed in a desired configuration, the turf panels are secured together, forming seams at various locations throughout the turf structure. For example, in FIG. 1C, uniformly colored green panels were spaced apart to provide a space for receiving turf panels of a different color to form a dashed line within the turf installation. Conventionally, in any region of an artificial turf installation where multiple colors or patterns are required, it is contemplated that a separate panel (or other structure) or separate series of panels is required for each graphical element of the turf installation. These conventional techniques are susceptible to inconsistency in integrity and performance, and cutting and gluing (and other installation steps), particularly when extensive, can be inefficient and uneconomical.

As further disclosed herein, it is contemplated that the disclosed tufted articles (e.g., artificial turf panels) can provide complementary, integrated colored graphics, minimizing installation requirements to only the adhesion of adjacent, complementary panels that cooperate with one another to define a continuous face pattern (across multiple panels that are only secured together along complementary side edges). Thus, it is contemplated that the disclosed surface coverings (formed by the disclosed tufted articles) can be installed with improved consistency, integrity, and efficiency in comparison to conventional methods. It is further contemplated that the disclosed systems for producing such tufted articles can permit variation of the specifications of the tufted articles (e.g., artificial turf panels) using purely computerized changes to the system, without the need for operational stoppages. The tufted articles produced by the disclosed systems can have multiple pile lengths and variable yarn density (controlled by the number of stitches), and modifications of these parameters can be driven by changes in yarn type (for example, using multiple tufting gantries). It is contemplated that the disclosed systems and methods can avoid many of the economic and efficiency issues associated with conventional turf installations by permitting production of a unitary tufted article that results from a single tufting process, without the need for the production of separate tufted articles for each section of the overall installation that has a different color and/or texture.

Tufted Articles and Surface Coverings Formed by Such Tufted Articles

Figure 2A:
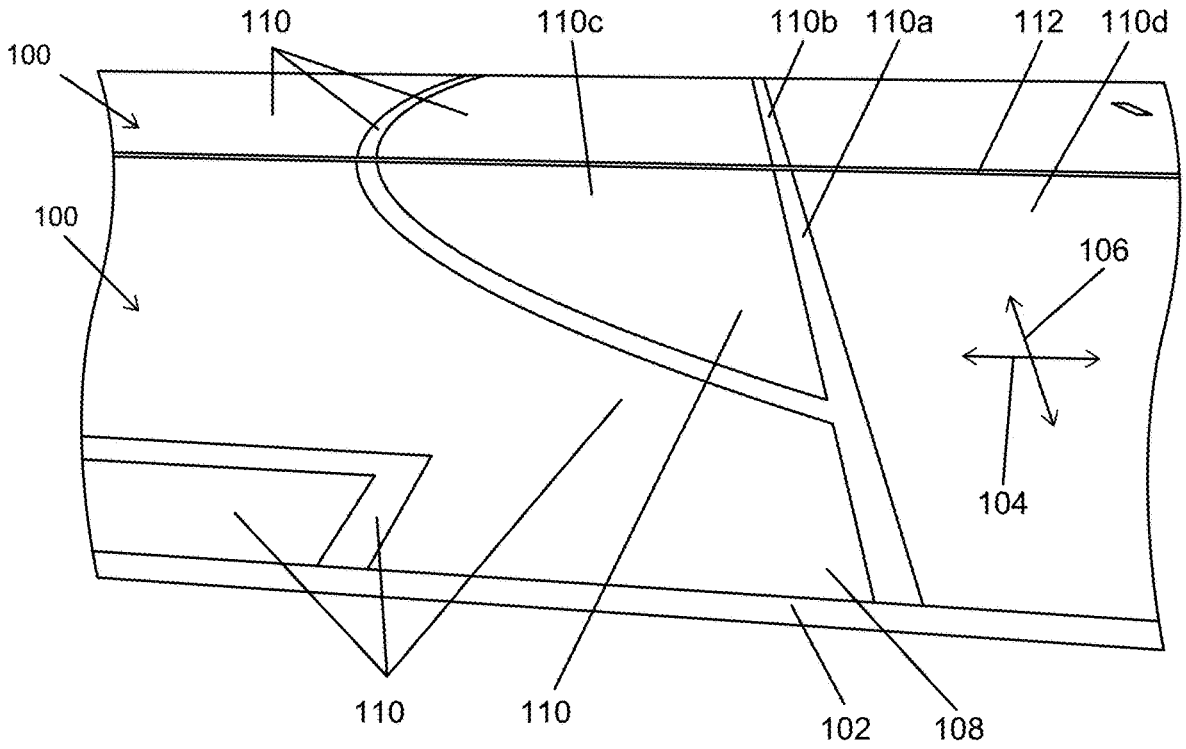
FIGS. 2A-2C are images of exemplary tufted articles as disclosed herein.
Figure 2B:
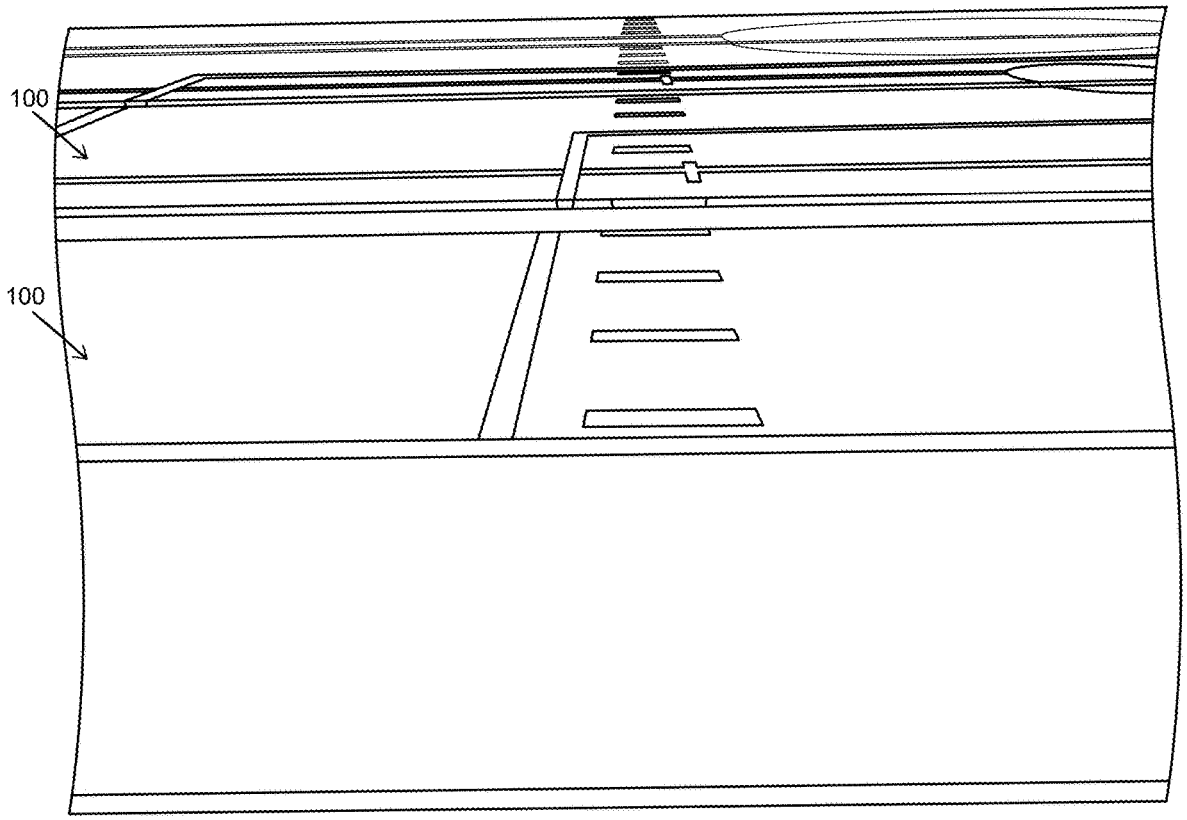
Figure 2C:
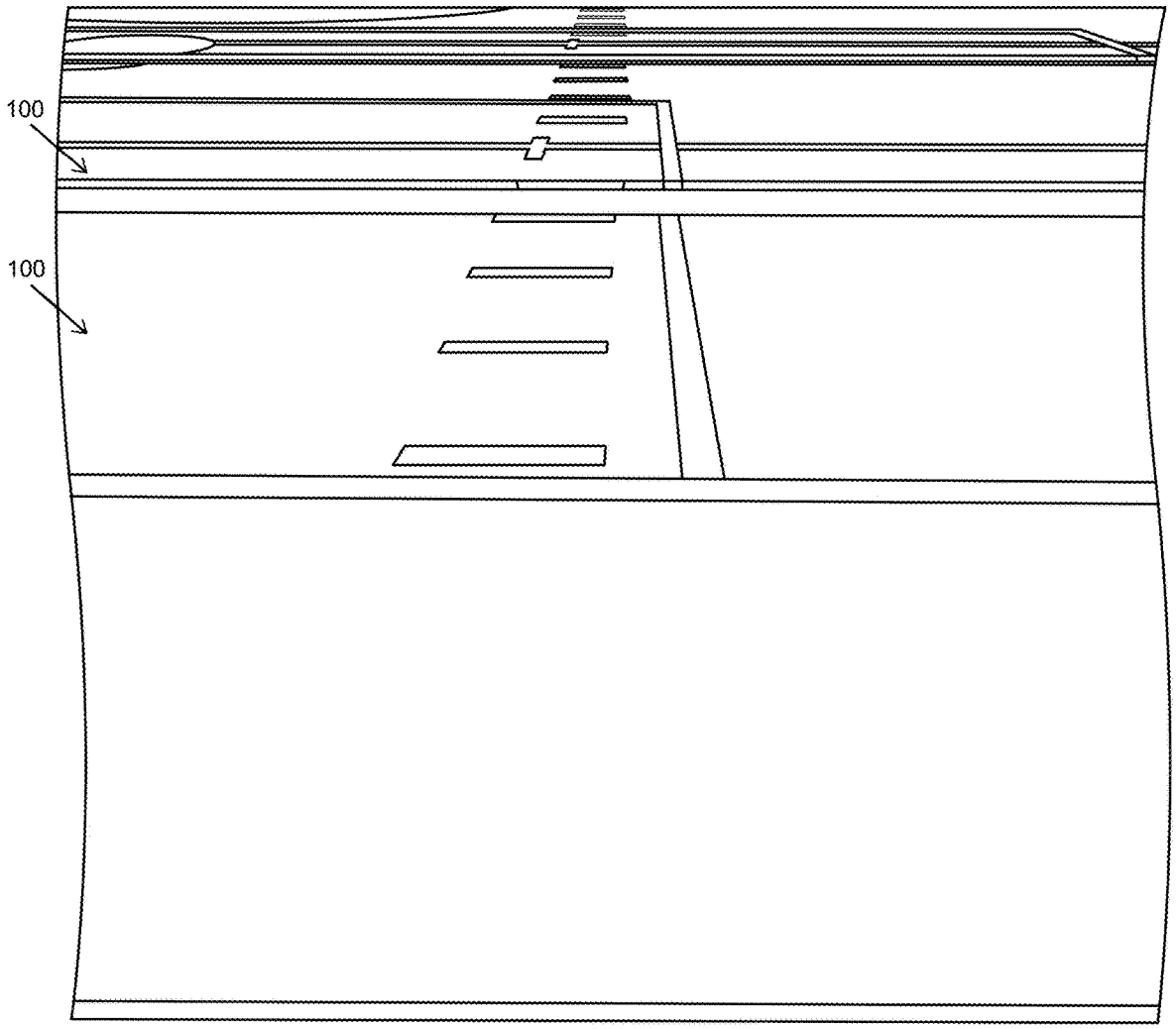

Referring to FIGS. 2A-2C, disclosed herein is a tufted article 100, which can optionally be an artificial turf product. The article can comprise a backing 102 having a length along a first axis 104 and a width along a second axis 106 that is perpendicular to the first axis 104. It is contemplated that the first axis 104 can optionally correspond to the axis 210 along which the backing is drawn through a tufting machine during manufacture. Each of the first axis 104 and the second axis 106 can be perpendicular to a vertical axis (not shown). As further disclosed herein, the backing 102 can be a backing that has a continuous structure, and the tufted article does not include seams within or associated with the continuous structure of the backing. Thus, in exemplary aspects, after production of the tufted article as disclosed herein, it is unnecessary to modify the tufted article to include inlay components (e.g., patches, panels, or other discrete structures having different yarn properties) within the tufted article.

A plurality of tufts 108 can extend through at least a portion of the backing. Optionally, the backing can include a primary backing or at least one backing layer through which the tufts are delivered and at least one secondary backing or at least one additional backing layer that supports the primary backing or first backing layer. For purposes of the following description, it is contemplated that the description of the backing during the tufting process refers to the portion of the backing through which tufts are delivered. However, it is understood that after the tufting process is completed, other backing materials or layers can be combined with the portions of the backing through which the tufts are delivered to produce a final product. In some optional aspects, it is contemplated that the backing can consist of a single layer.

The plurality of tufts 108 can be distributed among a plurality of patterned regions 110. Optionally, in preferred embodiments, each patterned region can comprise a plurality of tufts 108 (i.e., at least two sequential tufts) to ensure that each patterned region has sufficient tuft bind. It is contemplated that each tuft can correspond to (and be formed during) a respective needle penetration through the backing. In exemplary aspects, the tufts of each patterned region differ from the tufts of at least one other patterned region of the tufted article in at least one of color, pile height, yarn type, or yarn density. In further aspects, it is contemplated that each tufted article 100 can have a color pattern defined by the plurality of tufts 108 of the plurality of patterned regions 110. In these aspects, it is contemplated that at least one patterned region 110 (optionally, a plurality of patterned regions 110) can form a discontinuity (optionally, a plurality of discontinuities) in the color pattern moving along the first axis 104. As one example, with reference to FIG. 1A, patterned region 110*a* can be a first color, while second and third patterned regions 110*c*, 110*d* positioned on opposing sides of patterned region 110*a* can be colors different than the first color. Optionally, in this example, patterned region 110*c* and patterned region 110*d* can be the same color. However, in other aspects, it is contemplated that a plurality of sequential patterned regions can each comprise a different color or color pattern. Thus, whereas conventional tufted articles have a consistent color pattern moving along the first axis 104, with each row of tufts having consistent color properties, it is contemplated that the disclosed tufted articles can have at least one discontinuity that corresponds to a variation in color (that disrupts a color pattern) at any tuft location within the tufted article (moving in any direction, including along the first and/or second axes). In particular, within one or more rows of tufts extending parallel to the first axis 104, it is contemplated that a subgroup (optionally, a plurality of subgroups) of the tufts within a row can have a different color than at least one other subgroup of tufts within the row. Similarly or identically patterned and/or colored tufts of adjacent rows can cooperate to define a respective patterned region 110 of the tufted article 100.

In exemplary aspects, it is contemplated that the tuft sequences within a patterned region can extend along respective longitudinal axes. For example, a first tuft sequence can extend along a first longitudinal axis, and a second tuft sequence can extend along a second longitudinal axis that is parallel or angled perpendicularly or at an oblique angle (acute or obtuse angle) with respect to the first longitudinal axis. In some aspects, it is contemplated that a first needle of a first tufting machine that defines a first tufting zone can form the first tuft sequence. A second needle of a second tufting machine that defines a second tufting zone can form the second tuft sequence. In still further aspects, when the first longitudinal axis is parallel to the second longitudinal axis, it is contemplated that the first and second tuft sequences can be formed by respective needles of a single tufting machine.

Optionally, in exemplary aspects, it is contemplated that each patterned region can comprise or consist of a plurality of tufts having the same or substantially the same color. It is further contemplated that a first patterned region can have a pattern and/or color that is different from the pattern and/or color of a second patterned region. For example, the patterned regions can differ in color, pile height, spacing between tufts, types of yarn, and the like.

In some aspects, the tufted article 100 can be an artificial turf panel having a backing with a continuous structure. In such aspects, the article 100 can optionally comprise an infill. In these aspects, it is contemplated that the infill can comprise a single component or any combination of a plurality of components. When the infill comprises a plurality of components, it is contemplated that the infill material can optionally comprise a plurality of layers, with each layer corresponding to a different infill component or combination of components. Alternatively, it is contemplated that the plurality of components can be provided as a mixture, which can be either homogenous or non-homogenous. In exemplary aspects, it is contemplated that the infill can comprise clay, TPE, EPDM, coconut husks, walnut shells, crushed brick, sand, or combinations thereof. More generally, it is contemplated that the infill can comprise any material that is capable of imparting desired characteristics to a tufted article (i.e., artificial turf product) as disclosed herein.

In some aspects, it is contemplated that the tufts of different patterned regions can have different stitch lengths. As used herein, the term "stitch length" refers to the axial spacing between sequential tufts within a patterned region, with the axial spacing corresponding to the distance between the sequential penetrations of the backing through which the sequential tufts were formed.

In some aspects, the tufts of each patterned region can have a respective pile height, which corresponds to the distance by which a respective tuft extends above the upper surface of the backing 102. In some aspects, the pile heights of the tufts among patterned regions can vary. For example, in some aspects, the plurality of patterned regions 110 of the tufted article 100 can comprise a first patterned region and a second patterned region, and the tufts of the first patterned region have a different pile height than the tufts of the second patterned region.

In further aspects, the tufts of each patterned region can have a respective yarn density, which is determined based upon, among other factors, yarn type, the number of tufts, the pile height of the tufts, and the gauge of the tufts within the patterned region. In these aspects, it is contemplated that the yarn density among patterned regions can vary. For example, in some aspects, the plurality of patterned regions 110 of the tufted article 100 can comprise a first patterned region and a second patterned region, and the first patterned region can have a different yarn density than the second patterned region.

In still further aspects, the tufts of each patterned region can have a respective color or cooperate to define a consistent color pattern. In these aspects, it is contemplated that the color or color patterns among patterned regions can vary. For example, in some aspects, the plurality of patterned regions 110 of the tufted article 100 can comprise a first patterned region and a second patterned region, the tufts of the first patterned region can have a different color or color pattern than the tufts of the second patterned region.

In still further aspects, the tufts of each patterned region 110 can have a respective yarn type. In these aspects, it is contemplated that the yarn type among patterned regions can vary. For example, in some aspects, the plurality of patterned regions of the tufted article 100 can comprise a first patterned region and a second patterned region, and the tufts of the first patterned region can comprise a different yarn type than the tufts of the second patterned region. For example, in some aspects, the yarn of a first patterned region can be different from the yarn of a second patterned region in at least one of material, color, texture, denier and cross-section. In some aspects, the first patterned region and the second patterned region can be formed by respective needles (or groups of needles) of a single tufting machine. In further aspects, the first patterned region can be formed by one or more needles of a first tufting machine, and the second patterned region can be formed by one or more needles of a second tufting machine. In exemplary aspects, the plurality of tufts of each patterned region can comprise fibers, yarns, or combinations thereof. In one aspect, at least a portion of the tufts (optionally, each tuft) within at least one patterned region (optionally, each patterned region) can comprise cut yarns. Additionally, or alternatively, at least a portion of the tufts (optionally, each tuft) within at least one patterned region (optionally, each patterned region) can comprise loop yarns. Additionally, or alternatively, at least a portion of the tufts (optionally, each tuft) within at least one patterned region (optionally, each patterned region) can comprise monofilament fibers. Additionally, or alternatively, at least a portion of the tufts (optionally, each tuft) within at least one patterned region (optionally, each patterned region) can comprise slit films. Additionally, or alternatively, at least a portion of the tufts (optionally, each tuft) within at least one patterned region (optionally, each patterned region) can comprise one or more twisted variations of any of the above-identified yarn types. More generally, it is contemplated that the tufts within each patterned region can comprise any type of yarn or fiber or any combination of multiple types of yarns or fibers. Optionally, each patterned region can comprise synthetic fibers or yarns, such as, for example a material comprising one or more of a conventional nylon, polyester, polypropylene (PP), polyethylene (PE), polyurethane (PU), thermoplastic polyurethane (TPU), polyvinyl chloride (PVC), polyethylene terephthalate (PET), polypropylene terephthalate (PPT), polybutylene terephthalate (PBT), polytrimethylene terephthalate (PTT), ethylene vinyl acetate (EVA), latex, styrene butadiene rubber, or any combination thereof. It is contemplated that the conventional nylon of the face fibers or yarns can be, for example and without limitation, nylon 6/6, nylon 6, nylon 10, nylon 10/10, nylon 10/11, nylon 11, and the like. Additionally, the face fibers or yarns can comprise natural fibers, such as cotton, wool, or jute. In exemplary aspects, the face fibers or yarns can comprise one or more biodegradable materials, including, for example and without limitation, polylactic acid (PLA).

As further disclosed herein, in some optional aspects, it is contemplated that one or more of the patterned regions of the tufted article 100 can correspond to a portion of a graphical pattern or message. For example, in some aspects, at least one patterned region can correspond to a line or marker (for example, on a sports field or in wayfinding applications). As another example, in some aspects, at least one patterned region can form a portion of text (or a text-based message or statement). As another example, in some aspects, at least one patterned region can form a portion of a symbol or logo.

In exemplary aspects, and as shown in FIGS. 2A-2C, the tufted article can be configured to form at least a portion of a sports field. However, the tufted articles disclosed herein can be used in a variety of applications, including, for example and without limitation, parks, airport runways, and landfill covers.

Optionally, in exemplary aspects, the width of a tufted article can be less than or equal to 15 feet. In further exemplary aspects, the width of a tufted article can be less than or equal to 12 feet. In further exemplary aspects, the width of a tufted article can be less than 8 feet. In still further exemplary aspects, the width of a tufted article can be greater than 15 feet, such as for example, greater than or equal to 16 feet, greater than equal to 18 feet, greater than or equal to 20 feet, or greater than or equal to 25 feet. In further exemplary aspects, the length of a tufted article can be greater than 160 feet. In further exemplary aspects, the length of the tufted article can be at least 200 feet. In still further exemplary aspects, the length of the tufted article can range from 200 feet to 300 feet. In still further exemplary aspects, the length of the tufted article can be greater than 300 feet, such as, for example and without limitation, between 300 feet and 500 feet. In further exemplary aspects, the length of a tufted article can be less than 160 feet. More generally, it is contemplated that any combination of widths and lengths can be used depending on the desired application or installation site. In additional aspects, it is contemplated that the length of the tufted article can correspond to the full length of an installation, such as, for example and without limitation, the full width of a sports field, a full dimension of a landfill cover, a full dimension of a section of an airport runway (such as, for example, where grass or dirt would typically be located), a full dimension of a park surface, or a dimension that is sufficiently large to encompass or surround a logo, advertisement, text, or graphics.

In use, one or more tufted articles 100 can be secured together to form at least a portion of a surface covering, such as, for example and without limitation, an artificial turf field. As one example, a floor covering can comprise at least first and second tufted articles 100 as disclosed above. The first and second tufted articles 100 can comprise respective complementary side edges 112 that are secured together to form at least a portion of the surface covering. At the complementary side edges of the first and second tufted articles, each patterned region 110 of the first tufted article can be secured in alignment with a corresponding patterned region of the second tufted article to cooperatively define a continuous pattern extending from the first tufted article to the second tufted article. For example, FIG. 2A depicts complementary patterned regions 110*a*, 110*b* on adjacent tufted articles 100 that cooperate to define a continuous pattern extending across both tufted articles. In this particular example, complementary patterned regions 110*a*, 110*b* correspond to respective portions of a line/boundary on a sports field, whereas adjacent patterned regions on the two tufted articles 100 correspond to "unmarked" areas of the field. More generally, it is contemplated that the complementary patterned regions on adjacent tufted articles can cooperate to define any selected boundary, marking, field portion, text, or graphic design.

In further aspects, it is contemplated that the at least first and second tufted articles can comprise at least three tufted articles. In these aspects, at least one side edge of each tufted article of the at least three tufted articles can be secured to a complementary side edge of an adjacent tufted article of the at least three tufted articles to form the surface covering. At the complementary side edges of the adjacent tufted articles, corresponding patterned regions of the adjacent tufted articles can be in alignment with one another to cooperatively define a continuous pattern along the entirety of the complementary side edges. In exemplary aspects, the complementary side edges of two adjacent tufted articles-which extend along the lengths of the respective tufted articles—can be installed to define the entire width of a sports field or other installation. In the example shown in FIGS. 2B-2C, the tufted articles define the entire width of a football field, with each respective tufted article including hash marks, yard marks, and other markings that, when the tufted articles are secured together, allow for usage of the field without the need for using separate processes (e.g., cutting, patching, and the like) to produce the markings and boundaries on the field that are required for play.

When two or more tufted articles are secured together at complementary side edges to form a surface covering as disclosed herein, it is contemplated that the surface covering can be assembled without the use of inlay elements and without the need for cutting or trimming of any of the tufted articles that form the surface covering.

Optionally, in exemplary aspects, the tufted articles can comprise artificial turf articles (e.g., artificial turf panels). In further optional aspects, and as further disclosed herein, it is contemplated that the surface covering can be at least a portion of a sports field, such as a baseball field, a football field, a tennis court, a golf course, a cricket field, a soccer field, and the like. In exemplary aspects, it is contemplated that complementary patterned regions of adjacent tufted articles can cooperate to form particular sections of a sports field, such as, for example and without limitation, a tee box, fairway, rough, approach, collar, and/or green of a golf course, a grass, skin, and/or track area of a baseball field, a grass and/or pitch area of cricket grounds, white line sections for a tennis court, and the like.

A method of assembling and/or installing a surface covering using at least first and second tufted articles 100 can comprise securing complementary side edges of the first and second tufted articles together to form at least a portion of the surface covering. At the complementary side edges of the first and second tufted articles, each patterned region of the first tufted article can be in alignment with a corresponding patterned region of the second tufted article to cooperatively define a continuous pattern extending from the first tufted article to the second tufted article.

In further aspects, it is contemplated that the at least first and second tufted articles can comprise at least three tufted articles. In these aspects, the method can comprise securing at least one side edge of each tufted article of the at least three tufted articles to a complementary side edge of an adjacent tufted article of the at least three tufted articles to form the surface covering. At the complementary side edges of the adjacent tufted articles, corresponding patterned regions of the adjacent tufted articles can be in alignment with one another to cooperatively define a continuous pattern along the entirety of the complementary side edges.

Advantageously, it is contemplated that the methods described above need not comprise cutting any portion of the tufted articles or inserting an inlay element into a tufted article.

In particular installations, the first and second tufted articles comprise artificial turf panels. Optionally, as further disclosed herein, the surface covering is at least a portion of a sports field.

Systems and Methods of Making Tufted Articles

Figure 3:
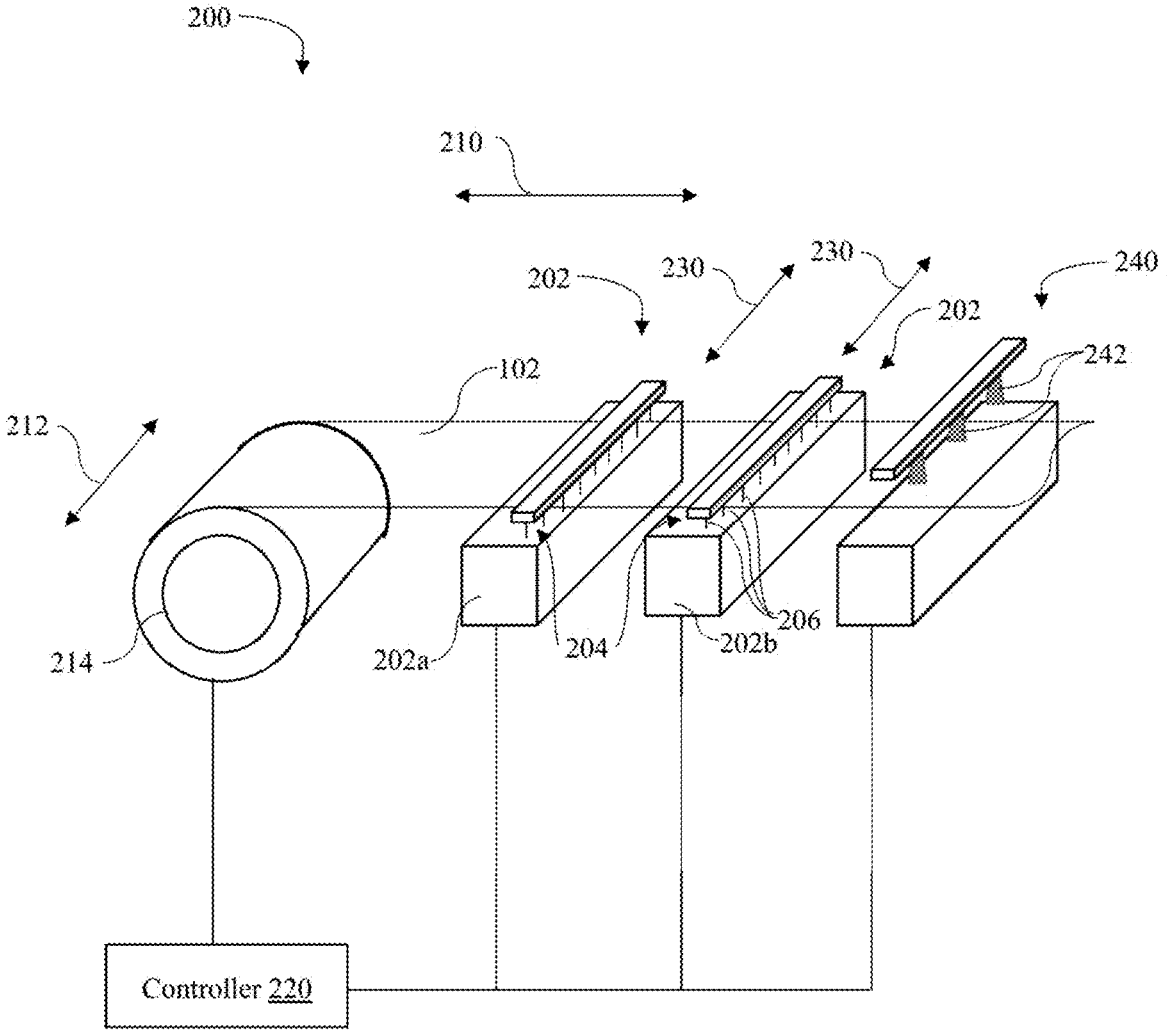
FIG. 3 is a schematic diagram of a system for producing a tufted article as disclosed herein.
Figure 4:
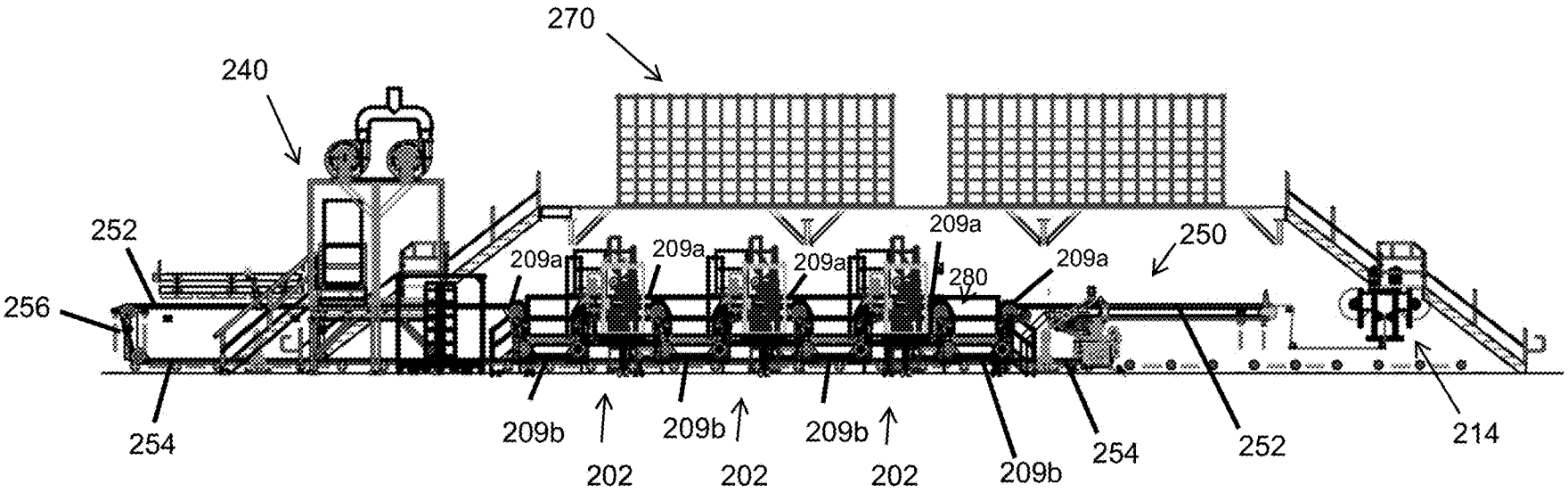
FIG. 4 is a side view of an exemplary system for producing a tufted article as disclosed herein.
Figure 5:
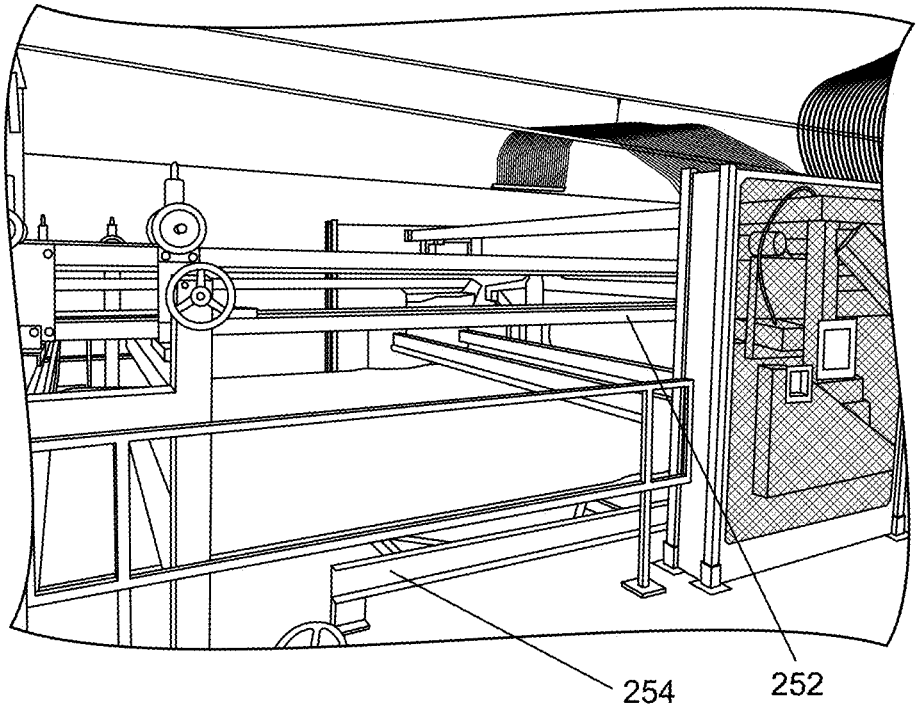
FIG. 5 is an image of a portion of a tensioning apparatus as disclosed herein. As shown, the tensioning apparatus includes a top section that receives a backing from a backing feed roll and a bottom section that receives tufted portions of the article after tufting and coating steps have been completed.
Figure 6:
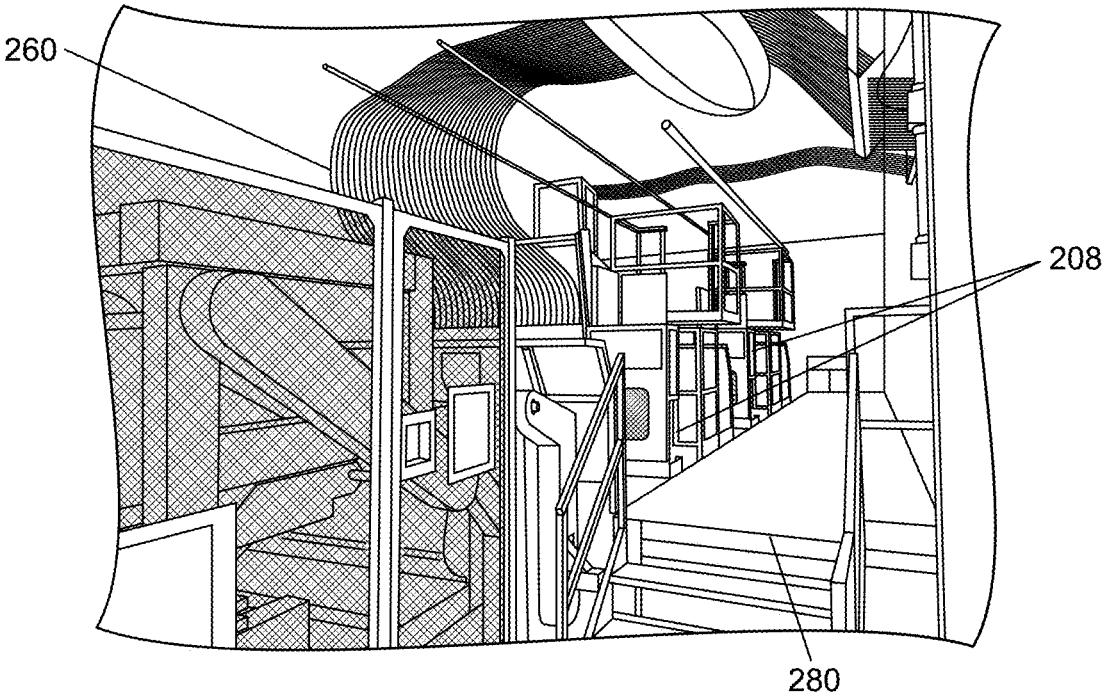
FIG. 6 is an image showing an end perspective view of a system for producing a tufted article as disclosed herein.
Figure 7:
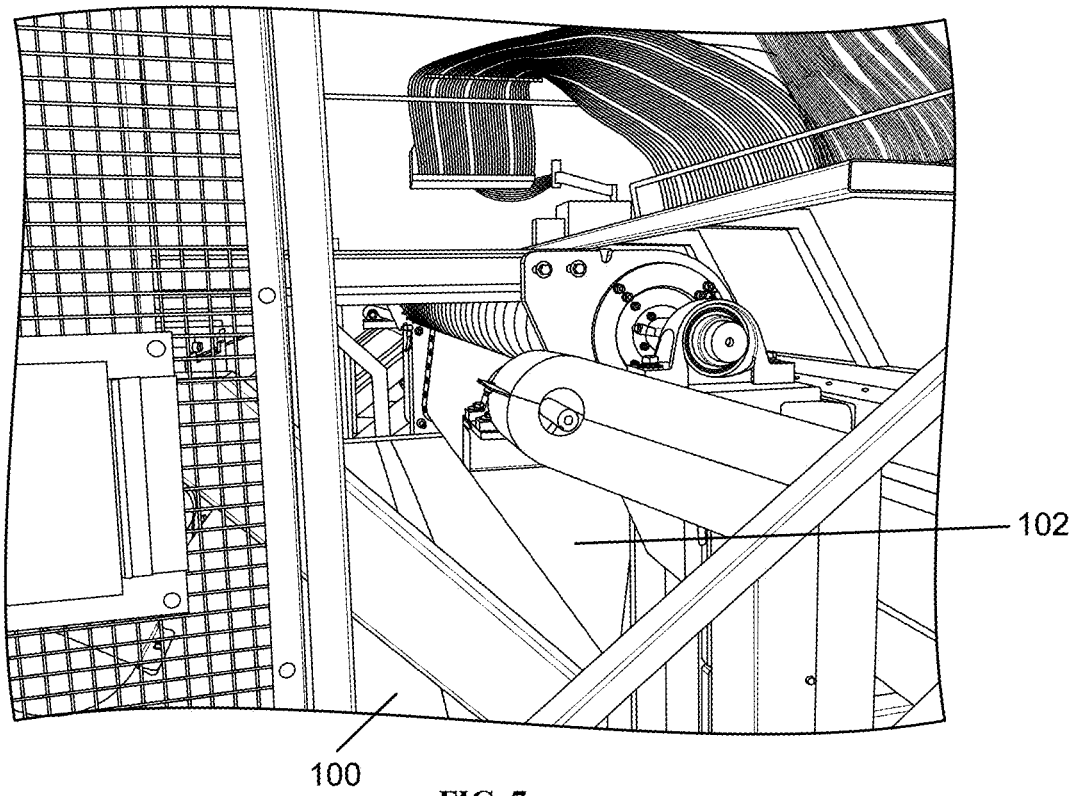
FIG. 7 is an image showing a transition of a backing on an upper portion of the tensioning apparatus from a peak (high point) to a valley (low point) as the tensioning apparatus passes under a portion of a catwalk.
Figure 8:
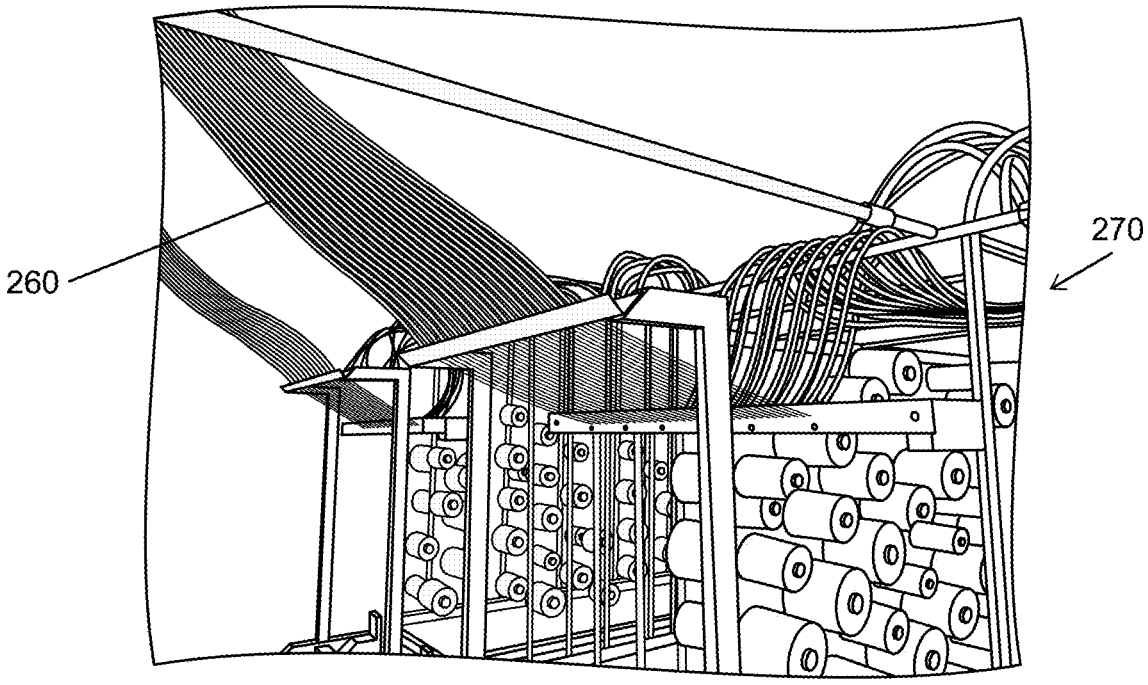
FIG. 8 is an image showing a plurality of creels to which a plurality of yarn packages are mounted. As shown, the yarn from the yarn packages can be delivered to the tufting machines of the system using yarn tubes.

As shown in FIGS. 3-4, a system 200 for manufacturing the article 100 can comprise one or more tufting machines 202. Each tufting machine 202 can define a respective tufting zone 204. Each tufting machine can comprise a plurality of needles 206 that are configured to deliver yarn into the backing 102 to form a plurality of tufts 108 that extend through the backing. Optionally, as shown in FIG. 6, each tufting machine 202 of the plurality of tufting machines can comprise a gantry 208. The backing can have a length along the first axis 210 and a width along a second axis 212 that is perpendicular to the first axis.

The backing can be provided on a backing feed roll 214 that is configured to feed the backing through the tufting machine(s). As shown in FIGS. 4-7 and 9, the backing feed roll can provide the backing to at least one tensioning apparatus 250, which is configured to guide the backing through the plurality of tufting machines while applying tension to the backing.

One or more controllers 220 can be communicatively coupled to the tufting machine(s) 202. It is contemplated that the controller 220 as illustrated can be embodied as a plurality of controllers, each having a memory in communication with a processor, wherein the plurality of controllers cooperatively control the system 200 to form the tufted articles as disclosed herein. For example, in some aspects, each tufting machine 202 can be in communication with a respective controller 220. Alternatively, it is contemplated that a single controller (with a central memory in communication with a central processor) can be configured to control operation of each tufting machine.

The controller 220 can be configured to cause each tufting machine, which can have at least one respective needle bar supporting a plurality of needles, to selectively control tufting of yarn into the backing to produce the plurality of tuft sequences. Thus, it is contemplated that each needle of the tufting machine can be configured to selectively form a tuft (or a tuft sequence). For example, each needle of the tufting machine can be independently and selectively actuated to penetrate the backing to form a tuft or tuft sequence. While some needles are actuated to deliver yarn through a backing to form respective tuft sequences, other needles of the tufting machine are not instructed to deliver yarn through the backing. Examples of tufting machines having such independently controllable needles are well known and have not been discussed in detail herein. Optionally, the needles 206 can be operatively associated with a conventional needle bar as is known in the art. In alternative aspects, it is contemplated that the needles of a respective tufting machine can be divided among a plurality of needle modules as further disclosed herein. In these aspects, it is contemplated that each needle module of the plurality of needle modules can have a plurality of needles that are independently moveable relative to the needles of other needle modules of the plurality of needle modules, thereby limiting the number of needles that need to move for a given tufting cycle and providing less wear and tear on the tufting equipment. Although not shown herein, it is contemplated that the system 200 can further comprise loopers and/or cutting assemblies as are conventionally used to pull and/or cut tufts. In exemplary aspects, the needle bar assemblies (and, optionally, the looper assemblies) can be controlled by servo motors (optionally, in communication with the controller 220) as are known in the art.

The controller 220 can comprise at least one processor and memory with instructions thereon. The at least one processor can be configured to execute instructions that cause the tufting machine(s) to selectively form tufts that produce a plurality of patterned regions as disclosed herein. For example, the controller can cause each needle of the tufting machine to selectively form tuft sequences or not form tuft sequences as the backing is moved along the first axis 210. In this way, the controller can be configured to cause the tufting device to form a plurality of tuft sequences, with the tufts of each tuft sequence being formed sequentially by a single needle. The controller can be configured to cause the tufting machine(s) 202 to form tuft sequences that are spaced from other along at least one of the first axis 210 and the second axis 212.

In some aspects, the memory of the controller can comprise instructions that when executed by the at least one processor, cause the processor to generate a tufting pattern comprising at least one tufting parameter for a plurality of patterned regions. The parameter(s) can comprise a spacing between adjacent tuft sequences relative to the second axis, a tuft sequence length, a number of tufts per tuft sequence, a tuft pile height, and a yarn type.

In some aspects, the first tufting machine can be rotationally offset from the second tufting machine. For example, each tufting machine can have a longitudinal axis 230 along which each needle is spaced. It is contemplated that the longitudinal dimension of a first tufting machine 202*a* can optionally be oblique (at an acute or obtuse angle) with respect to the longitudinal axis 230 of a second tufting machine 202*b*.

It is further contemplated that the plurality of needles 206 of each tufting machine can optionally be spaced relative to each other adjacent needle by a select gauge relative to the longitudinal axis of the tufting machine. It is contemplated that the select gauge of the first tufting machine 202*a* can be optionally be greater or less than the select gauge of the second tufting machine 202*b*.

In some optional aspects, it is contemplated that the first tufting machine can be configured to form stitch sequences having stitches of a first stitch length, and the second tufting machine can be configured to form stitches having a second stitch length that is optionally different (i.e., greater than or less than) the first stitch length.

In some optional aspects, it is contemplated that a rotational orientation of the first tufting machine 202*a* can be offset from a rotational orientation of the second tufting machine 202*b* by 180 degrees. In these aspects, it is contemplated that the direction of movement of the backing relative to the first tufting machine can be opposite the direction of movement of the backing relative to the first tufting machine.

In some aspects, the system 200 can further comprise a coating machine 240 that is configured to apply a coating (e.g., optionally, polyurethane) on backstitches of the tufted article. After curing, the tufts of the article can be securely locked in place. For example, at least one nozzle 242 (optionally, a plurality of nozzles) can be configured to spray a coating on at least a portion of the backstitches of the tufted article.

In exemplary aspects, the system 200 can further comprise one or more creel assemblies 270 that support yarn packages can be positioned to the sides of or above the plurality of tufting machines. It is contemplated that different sections of the creel assemblies 270 can have different yarn types and/or different color yarns, the distribution of which among the plurality of needles of the tufting machines can be monitored by the controller 220 to determine particular needles or groups of needles that should deliver yarn within a particular tufting zone to achieve a selected tufting pattern. In further aspects, the system 200 can comprise a yarn delivery assembly 260 that is configured to deliver yarn from the creel assemblies 270 to respective needles of the tufting machines. In these aspects, it is contemplated that the yarn delivery assembly 260 can optionally comprise conventional yarn delivery tubes as are known in the art. It is contemplated that the needles of each tufting machine can be configured to receive different yarns than other needles of the same tufting machine. For example, it is contemplated that the needles of at least one tufting machine can comprise a first plurality of needles that receive a yarn having a first color and a second plurality of needles that receive yarn having a second color that is different than the first color. It is contemplated that the selection of yarn color and other yarn color characteristics can vary from needle-to-needle, both within a single tufting machine and among the plurality of tufting machines.

In additional aspects, the tensioning apparatus 250 can comprise a frame, a pair of laterally spaced endless chains, and a plurality of pin rollers that are configured to control application of longitudinal tension to the backing. Optionally, it is contemplated that the plurality of pin rollers can operate independently of one another. It is further contemplated that sets of such pin rollers can be positioned in between each pair of sequential tufting machines (gantries) to maintain a consistent application of tension throughout the tufting process. An exemplary tensioning apparatus can be a tenter apparatus having a frame, endless chains, and gripping pins as disclosed in U.S. Pat. No. 8,695,519, which is incorporated herein by reference in its entirety.

In exemplary aspects, and with reference to FIG. 4, the tensioning apparatus 250 can drive movement of the backing in a serpentine pattern comprising peak sections 209*a* where the backing passes through the gantry of a respective tufting machine and valley sections 209*b* where the backing is in between (before or after) sequential tufting machines. As shown, other peak sections 209*a* can be located where the backing is delivered to the tensioning apparatus from the feed roll and where the backing is delivered to the coating machine 240 (after tufting). In further aspects, the system can further comprise a catwalk assembly 280, such as shown in FIG. 6. In these aspects, it is contemplated that respective portions of the catwalk assembly can overlie valley sections 209*b* of the backing, thereby permitting free access to the needles and other portions of the tufting machines without the need for stopping operation of the system.

Figure 9:
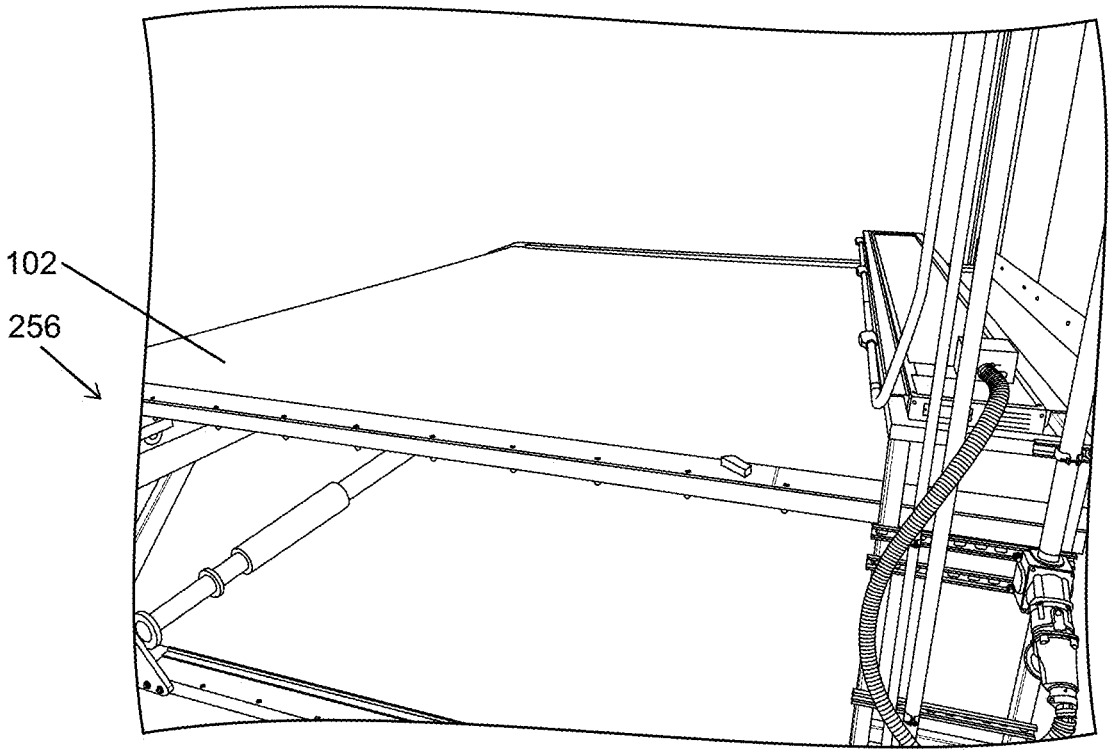
FIG. 9 is an image of a return section of the tensioning apparatus that receives the tufted article after a coating has been applied to the backstitches and reverses the direction of travel of the tufted article so that the tufted article can be returned toward the tufting machines and the backing feed roll. As shown, the return section of the tensioning apparatus can transition the tufted article from the upper section of the tensioning apparatus to the lower section of the tensioning apparatus.

In exemplary aspects, the tensioning apparatus 250 can have an upper level 252, a lower level 254, and a return section 256 that defines a transition between the upper level 252 and the lower level 254. After a tufting process has been completed (when the backing has passed through each tufting machine of the system), the tufted article can be delivered to the coating machine 240 as disclosed herein. As shown in FIG. 9, the return section of the tensioning apparatus can receive the tufted article after a coating has been applied to the backstitches and then reverse the direction of travel of the tufted article so that the tufted article can be returned toward the tufting machines and the backing feed roll. As shown, the return section of the tensioning apparatus can transition the tufted article from the upper section of the tensioning apparatus to the lower section of the tensioning apparatus. Optionally, in these aspects, it is contemplated that the upper level 252 of the tensioning apparatus 250 can define a serpentine pattern of the backing as discussed above. Optionally, the lower level 254 can have a planar profile.

Although shown as providing a continuous pathway for movement of the backing through the tufting process, it is contemplated that the at least one tensioning apparatus 250 can comprise a plurality of tensioning apparatuses that are each associated with a respective tufting machine.

In use, it is contemplated that the tensioning apparatus 250 can ensure that the operative width of the backing of the article 100 remains within a selected tolerance from the start of the tufting process to the finish of the tufting process (after coating has been applied to the backstitches). In exemplary aspects, the selected tolerance can be less than or equal to ⅓ inch. This close control of the operative width of the backing ensures that the alignment of the backing relative to the needles of a first tufting machine is the same or generally the same as the alignment of the backing relative to the needles of a second tufting machine, thereby ensuring that each needle of each tufting machine of the plurality of tufting machines is able to reliably deliver tufts within or substantially within a particular row of tufts within a tufting pattern for a tufted article. For example, a first tufting machine can be programmed to deliver a series of tufts having a first profile (color, pile height, yarn type, and the like) within a given row, and a second tufting machine can be programmed to deliver a second series of tufts having a second profile within the same row, with the first profile being different than the second profile. The reliability and consistency of the operative width of the backing throughout the process can ensure that the second series of tufts is delivered within or substantially within the same row that the first series of tufts was delivered. This principle applies for each row of tufts and across all tufting machines, thereby providing the system with the ability to selectively deliver tufts at any location within any row as the backing passes through each respective tufting machine.

Optionally, in addition to being in communication with the plurality of tufting machines, the controller 220 can be in communication with one or more of the backing feed roll 214, the tensioning apparatus 250, the coating machine 240, or the yarn delivery assembly 260 to selectively control movement of the backing, application of coating material to the backstitches of the tufted article, and/or delivery of yarn to the tufting machines.

In exemplary aspects, a method of manufacturing a tufted article as disclosed herein can comprise tufting the plurality of tufts through the backing. In these aspects, tufting the plurality of tufts through the backing can comprise using a plurality of sequentially positioned tufting machines to tuft respective portions of the plurality of tufts, with each tufting machine defining a respective tufting zone.

In further aspects, each tuft of the plurality of tufts can have a backstitch. In these aspects, and as further disclosed herein, the method can further comprise applying a coating over the backstitches of the plurality of tufts.

Optionally, in exemplary aspects, the tufting zones of the plurality of sequentially positioned tufting machines are positioned along a machine axis corresponding to a direction of movement of the backing through the tufting machines. Optionally, in some aspects, the tufting zone of at least one tufting machine of the plurality of tufting machines can be spaced from the tufting zone of at least one other tufting machine of the plurality of tufting machines along a transverse axis that is perpendicular to a direction of movement of the backing through the tufting machines. In these aspects, the method can comprise shifting the backing along the transverse axis such that at least a portion of the backing passes through the tufting zone of each tufting machine, in either a continuous or non-continuous manner.

In exemplary aspects, when at least one tufting machine comprises a needle bar assembly having a plurality of needle modules, the step of tufting the plurality of tufts can comprise using a selected number of needle modules of said at least one tufting machine to deliver yarn to the backing. In these aspects, it is contemplated that the selected number of needle modules can be less than a total number of needle modules of said at least one tufting machine. It is further contemplated that at least one needle module of the plurality of needle modules of said at least one tufting machine may not deliver yarn to the backing during tufting.

In further exemplary aspects, when each tufting machine of the plurality of sequentially positioned tufting machines comprises a gantry, the method can further comprise using a tensioning apparatus (or a plurality of tensioning apparatuses) to deliver the backing through one or more of the gantries of the plurality of sequentially positioned tufting machines. Optionally, as further disclosed herein, the tensioning apparatus can drive movement of the backing in a serpentine pattern comprising peaks when the backing passes through the gantry of a respective tufting machine and valleys when the backing is in between sequential tufting machines.

In further exemplary aspects, when a controller is communicatively coupled to each tufting machine of the plurality of sequentially positioned tufting machines, the plurality of sequentially positioned tufting machines can form a first tufting pattern using a set of tufting parameters, and the method can further comprise using the controller to modify at least one of the tufting parameters to provide a second tufting pattern that is different from the first tufting pattern. In these aspects, said at least one tufting parameter can comprise at least one of pile height, yarn density, or yarn color. Advantageously, it is contemplated that the controller can modify said at least one tufting parameter without mechanically changing the configuration of the plurality of tufting machines.

Computing Device

Figure 10:
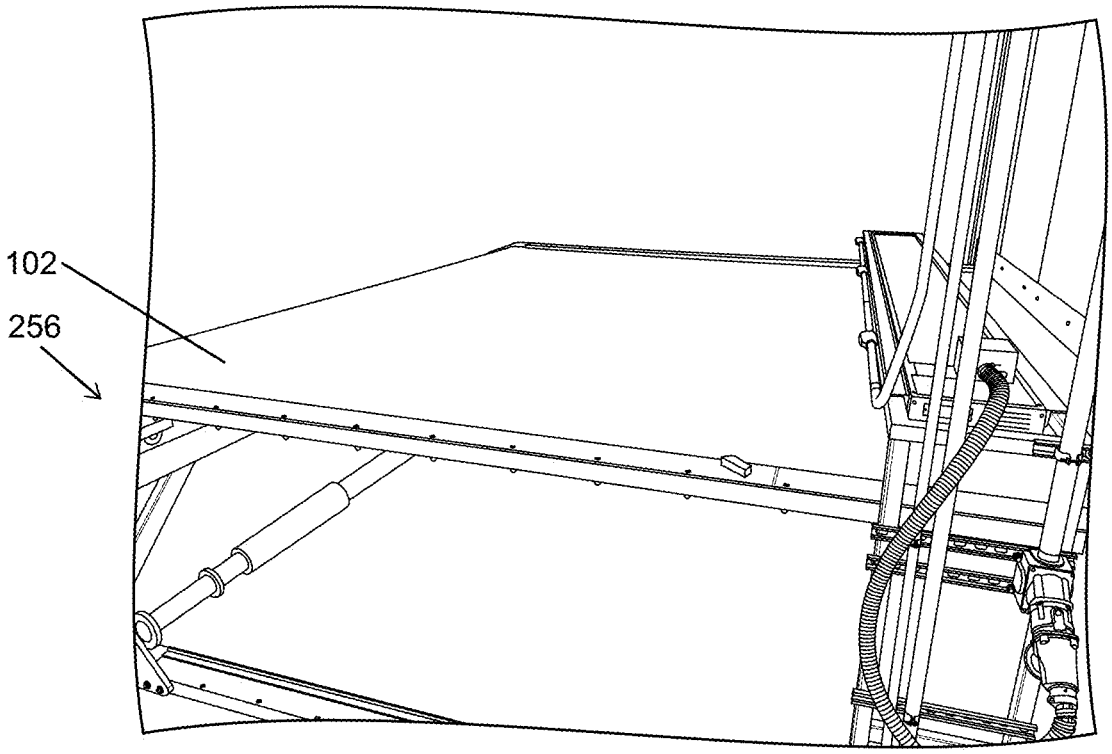
FIG. 10 is a computing device for controlling production of a tufted article as disclosed herein.

FIG. 10 shows a computing system 1000 including an exemplary configuration of a computing device 1001 for controlling the system 200. For example, the controller 220 (FIG. 3) can be embodied as one or more computing devices 1001 as further disclosed herein.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as pattern data 1007 (i.e., data provided by a system operator or generated by software that is executed by a processor) and/or program modules such as operating system 1005 and tufting machine control software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and tufting machine control software 1006 may be stored on the mass storage device 1004. One or more of the operating system 1005 and tufting machine control software 1006 (or some combination thereof) may comprise program modules and the tufting machine control software 1006. The pattern data 1007 may also be stored on the mass storage device 1004. The pattern data 1007 may be stored in any of one or more databases known in the art. The databases may be centralized or distributed across multiple locations within the network 1015.

A user may enter commands and information into the computing device 1001 using an input device (not shown). Such input devices comprise, but are not limited to, a keyboard, pointing device (e.g., a computer mouse, remote control), a touchscreen, a microphone, a joystick, a scanner, tactile input devices such as gloves, and other body coverings, motion sensor, and the like. These and other input devices may be connected to the one or more processors 1003 using a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 using an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. In addition to the display device 1011, other output peripheral devices may comprise components such as speakers (not shown) and a printer (not shown) which may be connected to the computing device 1001 using Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made using a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet. It is contemplated that the remote computing devices 1014*a,b,c* can optionally have some or all of the components disclosed as being part of computing device 1001.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A tufted article having a length along a first axis and width along a second axis that is perpendicular to the first axis, the first and second axes being perpendicular to a vertical axis, the tufted article comprising:

a backing having a continuous structure; and a plurality of tufts extending through at least a portion of the backing, the plurality of tufts distributed among a plurality of patterned regions, wherein each patterned region comprises at least one tuft of the plurality of tufts, wherein the tufts of each patterned region differ from the tufts of at least one other patterned region of the tufted article in at least one of color, pile height, yarn type, or yarn density, and wherein at least one patterned region forms a discontinuity in a color pattern of the tufted article moving along the first axis, wherein the tufted article does not comprise a seam within or associated with the continuous structure of the backing.

Aspect 2: The tufted article of aspect 1, wherein the tufted article is an artificial turf panel.

Aspect 3: The tufted article of aspect 1 or aspect 2, wherein the width of the tufted article is less than or equal to 15 feet, and wherein the length of the tufted article is greater than 160 feet.

Aspect 4: The tufted article of aspect 3, wherein the width of the tufted article is greater than 15 feet.

Aspect 5: The tufted article of any one of the preceding aspects, wherein the plurality of patterned regions comprises a first patterned region and a second patterned region, wherein the tufts of the first patterned region have a different pile height than the tufts of the second patterned region.

Aspect 6: The tufted article of any one of the preceding aspects, wherein the plurality of patterned regions comprises a first patterned region and a second patterned region, wherein the first patterned region has a different yarn density than the second patterned region.

Aspect 7: The tufted article of any one of the preceding aspects, wherein the plurality of patterned regions comprises a first patterned region and a second patterned region, wherein the tufts of the first patterned region have a different color than the tufts of the second patterned region.

Aspect 8: The tufted article of any one of the preceding aspects, wherein the plurality of patterned regions comprises a first patterned region and a second patterned region, wherein the tufts of the first patterned region comprise a different yarn type than the tufts of the second patterned region.

Aspect 9: The tufted article of any one of the preceding aspects, wherein at least one patterned region corresponds to a line or marker.

Aspect 10: The tufted article of any one of the preceding aspects, wherein at least one patterned region forms a portion of text.

Aspect 11: The tufted article of any one of the preceding aspects, wherein at least one patterned region forms a portion of a symbol or logo.

Aspect 12: The tufted article of any one of the preceding aspects, wherein the tufted article is configured to form at least a portion of at least one sports field.

Aspect 13: The tufted article of any one of aspects 1-11, wherein the tufted article is configured to form at least a portion of an airport runway.

Aspect 14: The tufted article of any one of aspects 1-11, wherein the tufted article is configured to form at least a portion of a landfill cover.

Aspect 15: A surface covering comprising:

at least first and second tufted articles as recited in any one of the preceding aspects, wherein the first and second tufted articles comprise respective complementary side edges that are secured together to form at least a portion of the surface covering, wherein, at the complementary side edges of the first and second tufted articles, each patterned region of the first tufted article is in alignment with a corresponding patterned region of the second tufted article such to cooperatively define a continuous pattern extending from the first tufted article to the second tufted article.

Aspect 16: The surface covering of aspect 15, wherein the at least first and second tufted articles comprises at least three tufted articles, wherein at least one side edge of each tufted article of the at least three tufted articles is secured to a complementary side edge of an adjacent tufted article of the at least three tufted articles to form the surface covering, wherein at the complementary side edges of the adjacent tufted articles, corresponding patterned regions of the adjacent tufted articles are in alignment with one another to cooperatively define a continuous pattern along the entirety of the complementary side edges.

Aspect 17: The surface covering of aspect 15 or aspect 16, wherein the surface covering does not comprise inlay elements.

Aspect 18: The surface covering of any one of aspects 15-17, wherein the first and second tufted articles comprise artificial turf panels.

Aspect 19: The surface covering of aspect 18, wherein the surface covering is at least a portion of at least one sports field.

Aspect 20: A method of manufacturing a tufted article according to any one of aspects 1-14, the method comprising:

tufting the plurality of tufts through the backing, wherein tufting the plurality of tufts through the backing comprises using a plurality of sequentially positioned tufting machines to tuft respective portions of the plurality of tufts, each tufting machine defining at least one respective tufting zone.

Aspect 21: The method of aspect 20, wherein each tuft of the plurality of tufts has a backstitch, and wherein the method further comprises applying a coating over the backstitches of the plurality of tufts.

Aspect 22: The method of aspect 20 or aspect 21, wherein the tufting zones of the plurality of sequentially positioned tufting machines are positioned along a machine axis corresponding to a direction of movement of the backing through the tufting machines.

Aspect 23: The method of aspect 20 or aspect 21, wherein a tufting zone of at least one tufting machine of the plurality of tufting machines is spaced from the tufting zone of at least one other tufting machine of the plurality of tufting machines along a transverse axis that is perpendicular to a direction of movement of the backing through the tufting machines, and wherein the method comprises shifting the backing along the transverse axis such that at least a portion of the backing passes through the tufting zone of each tufting machine.

Aspect 24: The method of any one of aspects 20-23, wherein at least one tufting machine of the plurality of sequentially positioned tufting machines comprises a needle bar assembly having a plurality of needle needles that are independently moveable relative to other needles of the plurality of needles, and wherein tufting the plurality of tufts comprises using a selected number of needles of said at least one tufting machine to deliver yarn to the backing.

Aspect 25: The method of aspect 24, wherein the selected number of needles is less than a total number of needles of said at least one tufting machine, and wherein at least one needle of the plurality of needles of said at least one tufting machine does not deliver yarn to the backing during tufting.

Aspect 26: The method of any one of aspects 20-25, wherein each tufting machine of the plurality of sequentially positioned tufting machines comprises a gantry, and wherein the method further comprises using at least one tensioning apparatus to deliver the backing through the gantries of the plurality of sequentially positioned tufting machines.

Aspect 27: The method of aspect 26, wherein the at least one tensioning apparatus comprises a single tensioning apparatus that defines a continuous pathway through the plurality of sequentially positioned tufting machines, wherein the single tensioning apparatus drives movement of the backing in a serpentine pattern comprising peaks when the backing passes through the gantry of a respective tufting machine and valleys when the backing is in between sequential tufting machines.

Aspect 28: The method of any one of aspects 20-27, wherein a controller is communicatively coupled to each tufting machine of the plurality of sequentially positioned tufting machines, wherein the plurality of sequentially positioned tufting machines form a first tufting pattern using a set of tufting parameters, wherein the method further comprises using the controller to modify at least one of the tufting parameters to provide a second tufting pattern that is different from the first tufting pattern, and wherein said at least one tufting parameter comprises at least one of pile height, yarn density, or yarn color.

Aspect 29: The method of aspect 28, wherein the controller modifies said at least one tufting parameter without mechanically changing the plurality of tufting machines or stopping operation of the plurality of tufting machines.

Aspect 30: A method of forming a surface covering using at least first and second tufted articles as recited in any one of aspects 1-14, wherein the first and second tufted articles comprise respective complementary side edges, the method comprising:

securing the complementary side edges of the first and second tufted articles together to form at least a portion of the surface covering, wherein, at the complementary side edges of the first and second tufted articles, each patterned region of the first tufted article is in alignment with a corresponding patterned region of the second tufted article such to cooperatively define a continuous pattern extending from the first tufted article to the second tufted article.

Aspect 31: The method of aspect 30, wherein the at least first and second tufted articles comprises at least three tufted articles, wherein the method comprises:

securing at least one side edge of each tufted article of the at least three tufted articles to a complementary side edge of an adjacent tufted article of the at least three tufted articles to form the surface covering, wherein at the complementary side edges of the adjacent tufted articles, corresponding patterned regions of the adjacent tufted articles are in alignment with one another to cooperatively define a continuous pattern along the entirety of the complementary side edges.

Aspect 32: The method of aspect 30 or aspect 31, wherein the method does not comprise inserting or installing an inlay element into a tufted article.

Aspect 33: The method of any one of aspects 30-32, wherein the first and second tufted articles comprise artificial turf panels.

Aspect 34: The method of aspect 33, wherein the surface covering is at least a portion of at least one sports field.

Aspect 35: A system comprising:

a plurality of tufting machines, each tufting machine defining a respective tufting zone and comprising a plurality of needles that are configured to deliver yarn into a backing to form a plurality of tufts that extend through at least a portion of the backing, the backing having a length along a first axis and a width along a second axis that is perpendicular to the first axis; and a backing feed roll that is configured to feed the backing through the plurality of tufting machines;

at least one tensioning apparatus that is configured to guide the backing through the plurality of tufting machines while applying tension to the backing; and at least one controller, wherein each controller of the at least one controller is communicatively coupled with each tufting machine of the plurality of tufting machines, wherein the at least one controller is configured to cause the plurality of tufting machines to selectively control delivery of yarn into the backing to produce a plurality of patterned regions.

Aspect 36: The system of aspect 35, wherein the controller is configured to cause the plurality of tufting machines to form a tufted article as in any one of aspects 1-14.

Aspect 37: The system of aspect 35 or aspect 36, wherein the controller comprises:

at least one processor; and a memory in communication with the at least one processor, wherein the memory comprises instructions that, when executed by the at least one processor, cause the processor to cause the plurality of tufting machines to selectively form the plurality of patterned regions.

Aspect 38: The system of any one of aspects 35-37, wherein each tufting machine of the plurality of tufting machines comprises a gantry, and wherein the at least one tensioning apparatus drives movement of the backing in a serpentine pattern comprising peak sections where the backing passes through the gantry of a respective tufting machine and valley sections where the backing is in between sequential tufting machines.

Aspect 39: The system of aspect 38, further comprising a catwalk assembly, wherein respective portions of the catwalk assembly overlie valley sections of the backing.

Aspect 40: The system of aspect 38 or aspect 39, wherein each tensioning apparatus of the at least one tensioning apparatus comprises a plurality of pin rollers that are configured to control application of longitudinal tension to the backing.

Aspect 41: The system of aspect 40, wherein the plurality of pin rollers operate independently of one another.

Aspect 42: The system of any one of aspects 35-41, further comprising a coating machine that is configured to apply a coating over backstitches of the plurality of tufts after the plurality of tufts have been delivered through the backing.

Although several embodiments of the invention have been disclosed in the foregoing specification and the following appendices, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A tufted article for defining a portion of a football field, the tufted article having a length along a first axis and width along a second axis that is perpendicular to the first axis, the first and second axes being perpendicular to a vertical axis, the tufted article comprising:

a backing having a continuous structure; and a plurality of tufts extending through at least a portion of the backing, the plurality of tufts distributed among a plurality of patterned regions, wherein each patterned region comprises at least one tuft of the plurality of tufts, wherein the tufts of each patterned region differ from the tufts of at least one other patterned region of the tufted article in at least one of color, pile height, yarn type, or yarn density, and wherein at least one patterned region forms a discontinuity in a color pattern of the tufted article moving along the first axis, wherein the plurality of patterned regions comprise a first patterned region simulating un-marked grass and a second patterned region corresponding to a marking that allows for usage of the football field, wherein the tufted article does not comprise a seam between the first patterned region and the second patterned region.

2. The tufted article of claim 1, wherein the length of the tufted article is sufficient to extend an entire width of a playing area of the football field.

3. The tufted article of claim 2, wherein the length of the tufted article is from 160 feet to 500 feet.

4. The tufted article of claim 3, wherein the marking of the second patterned region is a boundary.

5. A surface covering comprising:

a plurality of tufted articles, each tufted article comprising:

a backing having a continuous structure; and a plurality of tufts extending through at least a portion of the backing, the plurality of tufts distributed among a plurality of patterned regions, wherein each patterned region comprises at least one tuft of the plurality of tufts, wherein the tufts of each patterned region differ from the tufts of at least one other patterned region of the tufted article in at least one of color, pile height, yarn type, or yarn density, and wherein at least one patterned region forms a discontinuity in a color pattern of the tufted article moving along the first axis, wherein the tufted article does not comprise a seam between patterned regions, wherein the plurality of tufted articles are arranged edge-to-edge to define a playing area of a sports field, wherein the sports field is one of: a football field, a tennis court, a soccer field, a section of a golf course; a section of a baseball field; or a section of cricket grounds;

wherein each of the plurality of tufted articles extends along its respective length an entire dimension of the playing area of the sports field.

6. The system of claim 5, wherein the entire dimension of the playing area of the sports field is a width of the playing area.

7. The system of claim 5, wherein the entire dimension of the playing area of the sports field is a length of the playing area.

8. The system of claim 5, wherein the sports field is a football field.

9. The system of claim 8, wherein the entire dimension of the playing area of the sports field is a width of the football field.

10. The system of claim 9, wherein the plurality of patterned regions cooperate to define hash marks and yard marks.

11. The system of claim 9, wherein the plurality of patterned regions cooperate to define boundary markings of the football field.

12. The system of claim 8, wherein the plurality of tufted articles cooperate to form the entire playing area of the football field.

13. The system of claim 5, wherein the sports field is a soccer field.

14. The system of claim 5, wherein adjacent pairs of the plurality of tufted articles define respective side edges, wherein the respective side edges of the adjacent pairs of the plurality of tufted articles are secured together.

15. The system of claim 5, wherein each tufted article of the plurality of tufted articles does not comprise a seam within or associated with the continuous structure of the backing of the tufted article.

16. The system of claim 5, wherein the plurality of patterned regions of at least one article of the plurality of articles comprise a first patterned region and a second patterned region, wherein the tufts of the first patterned region have a different color than the tufts of the second patterned region.

17. A method comprising:

aligning a plurality of tufted articles to define a playing area of a sports field, wherein each tufted article of the plurality of tufted articles comprises:

a backing having a continuous structure; and a plurality of tufts extending through at least a portion of the backing, the plurality of tufts distributed among a plurality of patterned regions, wherein each patterned region comprises at least one tuft of the plurality of tufts, wherein the tufts of each patterned region differ from the tufts of at least one other patterned region of the tufted article in at least one of color, pile height, yarn type, or yarn density, and wherein at least one patterned region forms a discontinuity in a color pattern of the tufted article moving along the first axis, wherein the tufted article does not comprise a seam between patterned regions, wherein each tufted article of the plurality of tufted articles extends an entire dimension of the playing area of the sports field, wherein the playing surface is a football field or a soccer field.

18. The method of claim 17, wherein aligning the plurality of tufted articles comprises arranging the plurality of tufted articles edge-to-edge.

19. The method of claim 17, further comprising securing respective side edges of adjacent pairs of the plurality of tufted articles together.

20. The method of claim 17, wherein the sports field is a football field, and wherein the entire dimension of the playing area of the sports field is a width of the football field.

* * * * *